US007995320B2

(12) United States Patent
Tofigh et al.

(10) Patent No.: US 7,995,320 B2
(45) Date of Patent: Aug. 9, 2011

(54) SYSTEM AND METHOD FOR PROTECTING A COIL STRUCTURE IN A CONTROLLED SWITCH

(75) Inventors: Farshid Tofigh, Mission Viejo, CA (US); Otmar Kruppa, Deiningen (DE)

(73) Assignee: Leach International Corporation, Buena Park, CA (US)

( * ) Notice: Subject to any disclaimer, the term of this patent is extended or adjusted under 35 U.S.C. 154(b) by 818 days.

(21) Appl. No.: 11/941,898

(22) Filed: Nov. 16, 2007

(65) Prior Publication Data

US 2009/0128979 A1 May 21, 2009

(51) Int. Cl.
*H01H 47/00* (2006.01)

(52) U.S. Cl. ..... 361/140

(58) Field of Classification Search ..... 361/140
See application file for complete search history.

(56) References Cited

U.S. PATENT DOCUMENTS

| | | | | |
|---|---|---|---|---|
| 3,297,912 | A * | 1/1967 | Scheppe | 315/238 |
| 3,761,730 | A * | 9/1973 | Wright | 307/10.1 |
| 5,181,155 | A * | 1/1993 | Beg et al. | 361/94 |
| 5,420,379 | A | 5/1995 | Zank et al. | |
| 5,471,035 | A * | 11/1995 | Holmes | 219/505 |
| 5,530,613 | A | 6/1996 | Bauer et al. | |
| 2005/0024174 | A1 * | 2/2005 | Kolb et al. | 335/220 |

OTHER PUBLICATIONS

International Search Report for Application No. PCT/US07/085026 filed Nov. 16, 2007, dated Apr. 15, 2008, mailed May 20, 2008, 2 pages.

Written Opinion for Application No. PCT/US07/085026 filed Nov. 16, 2007, dated Apr. 15, 2008, mailed May 20, 2008, 5 pages.

* cited by examiner

*Primary Examiner* — Stephen W Jackson
*Assistant Examiner* — Terrence R Willoughby
(74) *Attorney, Agent, or Firm* — Christie, Parker & Hale, LLP

(57) ABSTRACT

A system and method for protecting a coil structure in a controlled switch. In one embodiment, the invention relates to a circuit including at least one load switch connectable between a power source and a load and at least one auxiliary switch, each switch actuable between a default position and a switched position, a coil structure configured to actuate the at least one load switch and at least one auxiliary switch in response to a control input, the coil structure switchable between an actuating configuration for actuating the at least one load switch and the at least one auxiliary switch from the default position, and a holding configuration for holding the at least one load switch and the at least one auxiliary switch in the switched position, and a resettable current limiting device configured to limit the current flow in the actuating configuration of the coil structure if the current flow exceeds a threshold for a predetermined period of time, wherein the at least one auxiliary switch is configured to switch the coil structure from the actuating configuration to the holding configuration.

28 Claims, 6 Drawing Sheets

SYSTEM AND METHOD FOR PROTECTING A COIL STRUCTURE IN A CONTROLLED SWITCH

BACKGROUND TO THE INVENTION

The present invention relates generally to a system and method for protecting a coil structure used in a controlled switch. More specifically, the present invention relates to a system for protecting a coil structure that provides a switching force used to actuate one or more load switches. The coil structure generates the switching force in response to a sizable current. However, continual application of the current at the same level to the coil structure can cause damage to the coil.

SUMMARY OF THE INVENTION

Systems and methods are described for protecting a coil structure in a controlled switch. In many embodiments, the coil structure includes a switching configuration and a hold configuration. A substantial current can be provided to the coil structure in the switching configuration while a smaller current can be provided in the hold configuration. To protect against damage to the coil structure in the switching configuration caused by the substantial current, a resettable current limiting device can used to substantially limit current when the current exceeds a threshold over a predetermined period of time.

In one embodiment, the invention relates to a circuit including at least one load switch connectable between a power source and a load and at least one auxiliary switch, each switch actuable between a default position and a switched position, a coil structure configured to actuate the at least one load switch and at least one auxiliary switch in response to a control input, the coil structure switchable between an actuating configuration for actuating the at least one load switch and the at least one auxiliary switch from the default position, and a holding configuration for holding the at least one load switch and the at least one auxiliary switch in the switched position, and a resettable current limiting device configured to limit the current flow in the actuating configuration of the coil structure if the current flow exceeds a threshold for a predetermined period of time, wherein the at least one auxiliary switch is configured to switch the coil structure from the actuating configuration to the holding configuration.

In another embodiment, the invention relates to a switch circuit for actuating one or more load switches and at least an auxiliary switch, each of the one or more load switches and the auxiliary switches having a default position and a switched position, where the default position of the auxiliary switch is closed, the switch circuit including a main coil configured to receive a current from a control power source and to provide a force for holding the one or more load switches and the auxiliary switch in the switched position, where the main coil comprises a first end, a second end and a tap, a resettable current limiting device connected to the first end of the main coil and to the auxiliary switch, the resettable device configured to limit current flow when the current exceeds a threshold for a predetermined period of time, and a component coil comprising a portion of the main coil from the second end to the tap of the main coil, where the tap is connected to the auxiliary switch, and where the component coil is configured to provide a force for actuating the one or more load switches and the auxiliary switch from the default position.

In yet another embodiment, the invention relates to a method of operating a switch circuit including a coil structure configured to actuate at least one load switch and at least one auxiliary switch in response to a control input, the coil structure switchable between an actuating configuration for actuating the at least one load switch and the at least one auxiliary switch from a default position, and a holding configuration for holding the at least one load switch and the at least one auxiliary switch in a switched position, and a resettable current limiting device having a current threshold, the method including providing a switching current to the coil structure, generating, in response to the switching current, a force for switching the at least one load switch and the at least one auxiliary switch, and limiting the switching current flowing through the coil structure using the resettable current limiting device when the switching current exceeds the current threshold for a predetermined period of time.

DETAILED DESCRIPTION OF THE INVENTION

Figure 1:
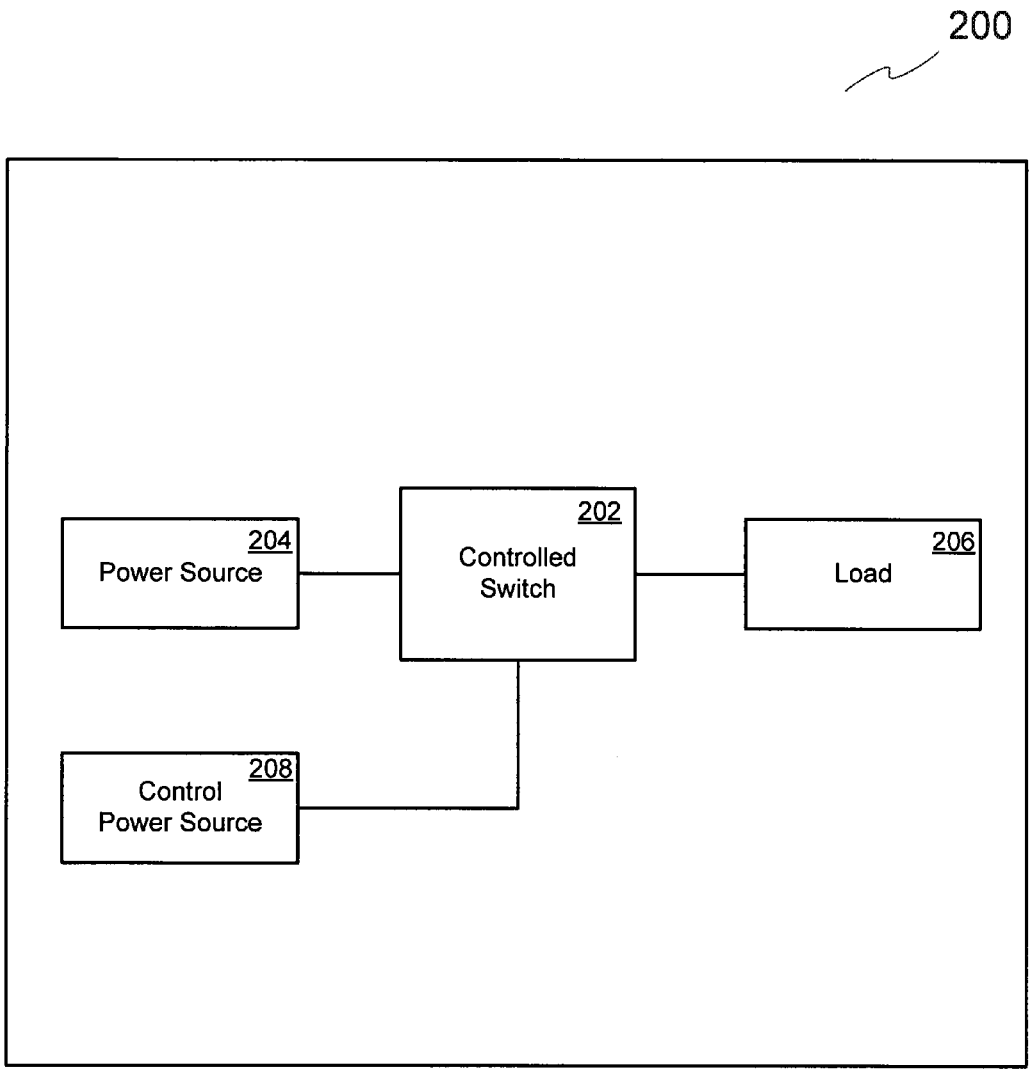
FIG. 1 is a schematic block diagram of a power control system in accordance with an embodiment of the present invention.

Turning now to the drawings, embodiments of systems and methods for protecting a coil in a controlled switch such as a contactor or a relay are illustrated. Controlled switches can be used to connect or disconnect loads of various sizes and phases from sources of power. Such controlled switches typically include a coil acting as an electromagnet to provide a force to switch the load when current is applied to the coil. This force can be used to switch one or more load switches together with an auxiliary switch. Substantial currents are provided to enable the coil to switch the load and the auxiliary switches. A hold or "economizer" coil is often used to decrease the amount of current needed to hold the armature(s) of the controlled switch in the switched position once the load and auxiliary switches have been actuated. In such case, a portion of the economizer coil can be used as an actuator or "pull-in" coil.

In operation, the control power source applies a voltage to generate a substantial current in the pull-in coil. The hold coil is placed in parallel with the normally closed auxiliary switch, causing it to short during the switching period. The pull-in coil can be placed in series with the auxiliary switch and can produce a switching force proportional to that substantial current supplied by the control power source. When the controlled switch is actuated by the switching force, the auxiliary contacts open and the economizer (hold) coil is placed in the current path. The economizer coil generally has a larger impedance than the pull-in coil, decreasing the current required from the control power source to keep the controlled switch in the switched position.

In the event that the auxiliary switch fails to operate, continuation of the substantial actuation current can cause permanent damage to, and the subsequent failure of, the coils. To avoid destruction of the coils and the controlled switch (e.g. relay) when the auxiliary switch fails to operate, a resettable current limiting device is placed in series with the pull-in coil and auxiliary switch. This resettable current limiting device substantially limits the current passing through the device when the current exceeds a threshold for a predetermined period of time. When the current drops below the threshold, the resettable device returns to its original state in which it conducts current with minimal limitation.

In one embodiment, the controlled switch can control the distribution of power in an aircraft electrical system. Power can be distributed using any of DC or AC (single, two or three phase) systems, or any combination thereof. In one embodiment, the controlled switch has two load switches that switch DC power sources. In several embodiments, the DC power sources operate at 28 volts, 26 volts or 270 volts. In one embodiment, DC power sources operate in the range of 11 to 28 volts. In other embodiments, the controlled switch has three load switches that switch AC power sources. In one embodiment, the AC power source operates at 115 volts and at a frequency of 400 hertz. In other embodiments, the controlled switch has a single load switch that can switch a DC power source or a single phase of an AC power source. In other embodiments, the power sources operate at other voltages and other frequencies. In one embodiment, the DC power sources can include batteries, auxiliary power units and/or external DC power sources. In one embodiment, the AC power sources can include generators, ram air turbines and/or external AC power sources.

A schematic block diagram of a power control system in accordance with an embodiment of the present invention is shown in FIG. 1. The power control system 200 includes a controlled switch 202 connected to a power source 204, a load 206 and a control power source 208. In operation, if the controlled switch 202 receives a signal from the control power source 208, the switch 202 connects or disconnects the load 206 from the power source 204.

In one embodiment, the power control system 200 is a subsystem of an aircraft electrical system. The power source 204 can be a generator, a battery or other AC or DC power sources. The load 206 can include aircraft flight instruments, essential systems such as landing gear, exterior lights, aircraft motor controls and the like, and/or passenger services such as lights, air conditioning and entertainment systems. In one embodiment, the loads range from requiring 1 to 400 amps. In another embodiment, the loads typically require 50 to 60 amps. The control power source 208 can be a signal generated in response to either automated systems or manual systems. In many embodiments, the control power source is capable of supplying an amount of current adequate to operate the controlled switch 202. In one embodiment, 6 to 7 amps from the control power source is sufficient to cause the controlled switch to connect or disconnect the load. In one embodiment, the controlled switch is a contactor. In another embodiment, the controlled switch is a relay.

Figure 2:
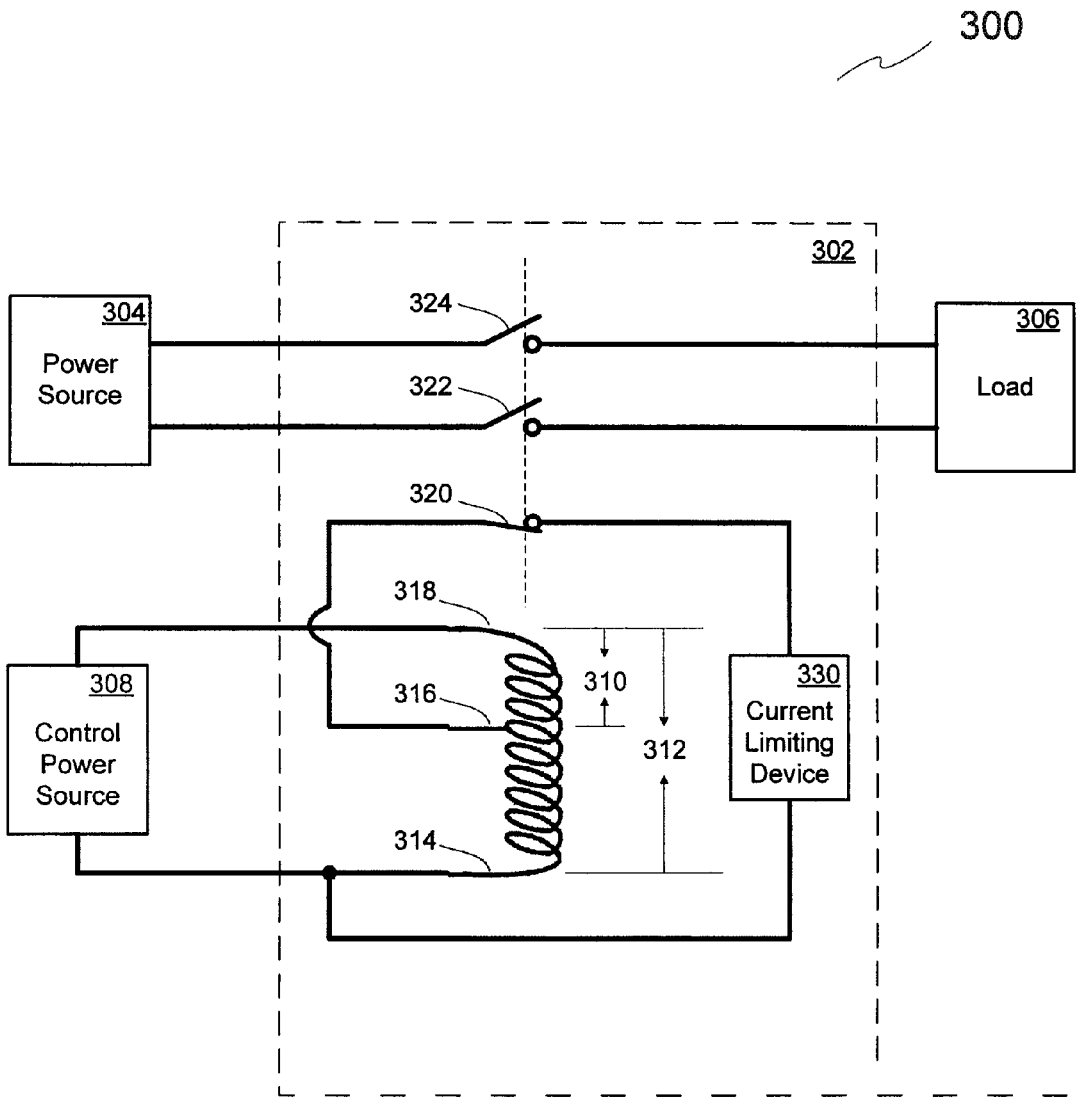
FIG. 2 is a schematic diagram of a power control system including a controlled switch with a current limiting device in accordance with an embodiment of the present invention.

A schematic block diagram of a power control system including a controlled switch with a current limiting device in accordance with an embodiment of the present invention is shown in FIG. 2. The power control system 300 includes a controlled switch 302, a power source 304, a load 306 and a control power source 308. The controlled switch 302 includes a pull-in coil 310, an economizer coil 312, an auxiliary switch 320, a first load switch 322, a second load switch 324, and a current limiting device 330. The economizer coil 312 includes a first end 314, a tap 316, and a second end 318, where the pull-in coil consists of the portion of the economizer coil extending from the second end 318 to the tap 316.

The power source 304 is connected to the first load switch 322 and the second load switch 324. The first load switch 322 and the second load switch 324 are connected to the load 306. The control power source 308 is connected to both the first end 314 and the second end 318 of the economizer coil 312. The auxiliary switch and first and second load switches each include a switch arm (armature) and a switch contact. The tap 316 is connected to the auxiliary switch 320. In the illustrated embodiment, the auxiliary switch 320 is normally closed and operates complimentary to the load switches that are normally open. The three switches are arranged such that all three are switched together. The auxiliary switch 320 is connected to the current limiting device 330. The first end 314 of the economizer coil 312 is connected to the current limiting device 330.

In operation, the control power source 308 provides a voltage and switching current to the pull-in coil 310 at the second end 318. At this time, the current limiting device 330 has minimal resistance to current flowing through the device. Thus, nearly all of the switching current initially travels through the pull-in coil 310 and out of the tap 316, through the auxiliary switch 320 and current limiting device 330, and returns to the current power source 308 via the first end 314. In one embodiment, the switching current provided by the control power source 308 enters at the first end 314 of the economizer coil 312 and returns via the second end 318.

The initial switching current can be substantial in order to facilitate switching using the pull-in coil. In one embodiment, the initial switching current or inrush current is approximately 6 to 7 amps. The pull-in coil acts as an electromagnet to create a force that physically switches or actuates the auxiliary switch and both of the load switches. Upon successful switching of the auxiliary switch, the switching current supplied by the control power source can be reduced as the force required to hold the switch in the switched position is generally less than the force required to operate the switch. This is accomplished by opening the auxiliary contact in parallel to the hold coil and therefore placing the hold coil, with greater impedance, in the path of the current.

The auxiliary switch can fail to open because of failed switch contacts, low voltage from the control power source or another reason. In any such case, the current limiting device senses the continuing switching current and acts to limit the current flowing through the device. In one embodiment, the current limiting device is a resettable fuse such as a thermistor or a polymer positive temperature coefficient (PPTC) fuse. In such case, the resettable fuse has a threshold or trip current such that when the threshold is exceeded for a predetermined period of time, the resettable fuse begins to heat up quickly. The heat changes the resistive properties of the resettable fuse such that the resistance of the device increases dramatically when the threshold is exceeded. In one embodiment, the resistance increases by at least an order of magnitude. In another embodiment, the resistance increases exponentially. However, when the current through the resettable fuse returns to a level below the threshold, the resistance of the fuse becomes minimal again as though it had been reset. In this way, the resettable fuse can be used any number of times to prevent switch failures from destroying the switching coil.

In one embodiment, the current limiting device can be a combination of components capable of comparing an input current level and a threshold over some period of time, and changing the overall impedance seen by the input current based on the comparison. The combination can include any number of devices including integrated circuits, processors and/or discrete devices coupled to one another.

In one embodiment, the threshold current must be exceeded for a period of time greater than 20 to 30 milliseconds before the resettable fuse heats up quickly to limit current flow. In one embodiment, the resettable fuse can be a POLYFUSE® resettable positive temperature coefficient fuse such as any of the 60R250, 60R300, and 60R375 fuses made by Littlefuse, Inc. of Des Plaines, Ill. In such case, the threshold current can be 5, 6, and 7.5 amps, respectively. In one embodiment, the inrush current is greater than 6 to 7 amps. In another embodiment, the threshold current must be exceeded for a period of time much greater than 20 to 30 milliseconds. In one embodiment, two or more resettable fuses can be used together in parallel to increase the current capability and to extend the time for the combination of favor to substantially change their impedance. In another embodiment, two or more resettable fuses can be used together in series.

Returning briefly to FIG. 1, the controlled switch 202 functions in the same manner described above for the controlled switch 302 of FIG. 2, in one embodiment of the invention.

Figure 3:
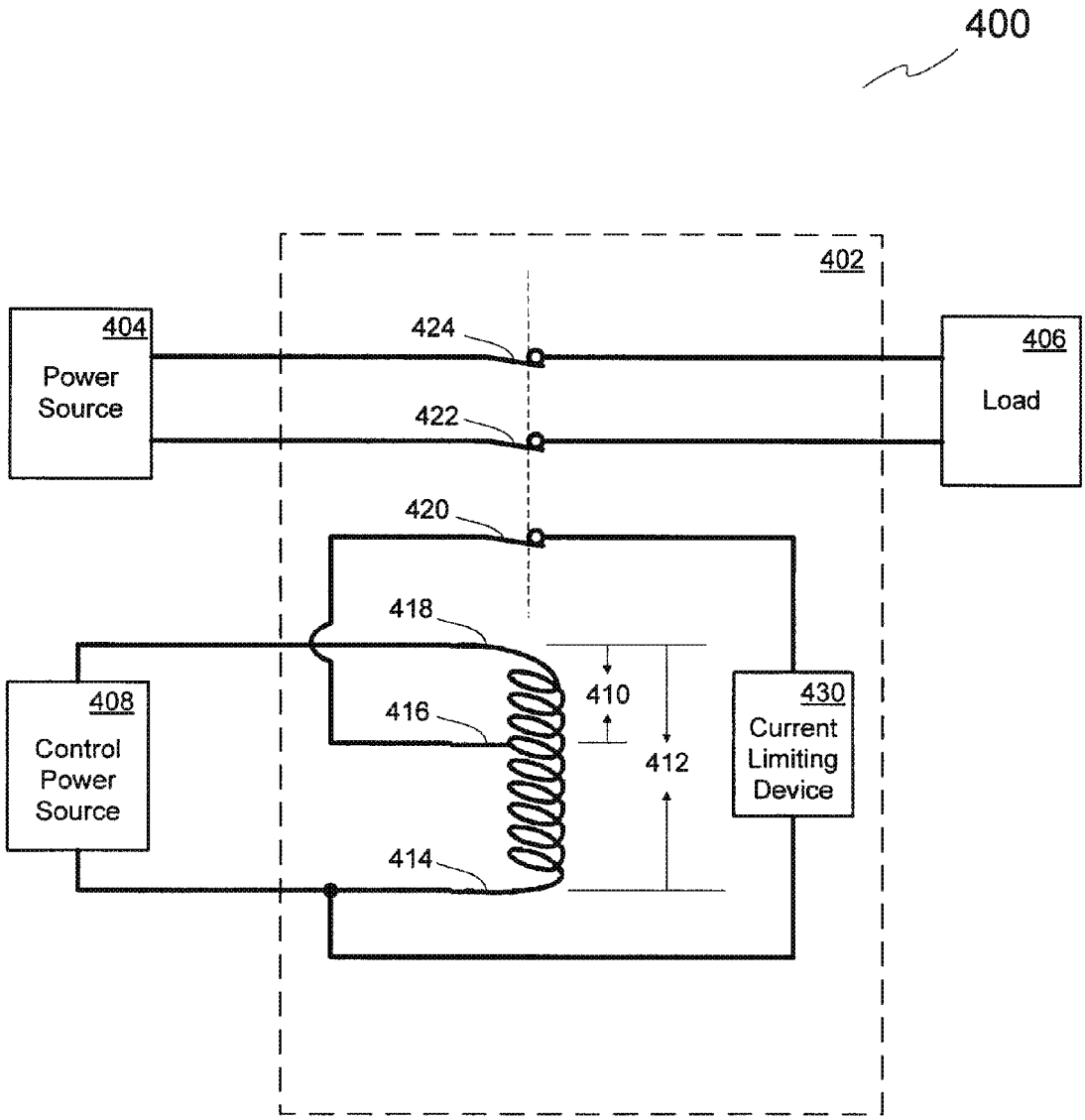
FIG. 3 is a schematic diagram of a power control system including a controlled switch having normally closed load switches in accordance with an embodiment of the present invention.

A schematic block diagram of a power control system including a controlled switch having normally closed load switches in accordance with an embodiment of the present invention is shown in FIG. 3. The power control system 400 includes a controlled switch 402, a power source 404, a load 406 and a control power source 408. The controlled switch 402 includes a pull-in coil 410, an economizer coil 412, an auxiliary switch 420, a first load switch 422, a second load switch 424, and a current limiting device 430. The economizer coil 412 includes a first end 414, a tap 416, and a second end 418, where the pull-in coil consists of the portion of the economizer coil extending from the second end 418 to the tap 416.

The power source 404 is connected to the first load switch 422 and the second load switch 424. The first load switch 422 and the second load switch 424 are connected to the load 406. The control power source 408 is connected to both the first end 414 and the second end 418 of the economizer coil 412. The auxiliary switch and first and second load switches each include a switch arm and a switch contact. The tap 416 is connected to the auxiliary switch 420. In the illustrated embodiment, the auxiliary switch 420 and the load switches are normally closed. The three switches are arranged such that all three are switched together. The auxiliary switch is connected to the current limiting device 430. The first end 414 of the economizer coil 412 is connected to the current limiting device 430.

Figure 4:
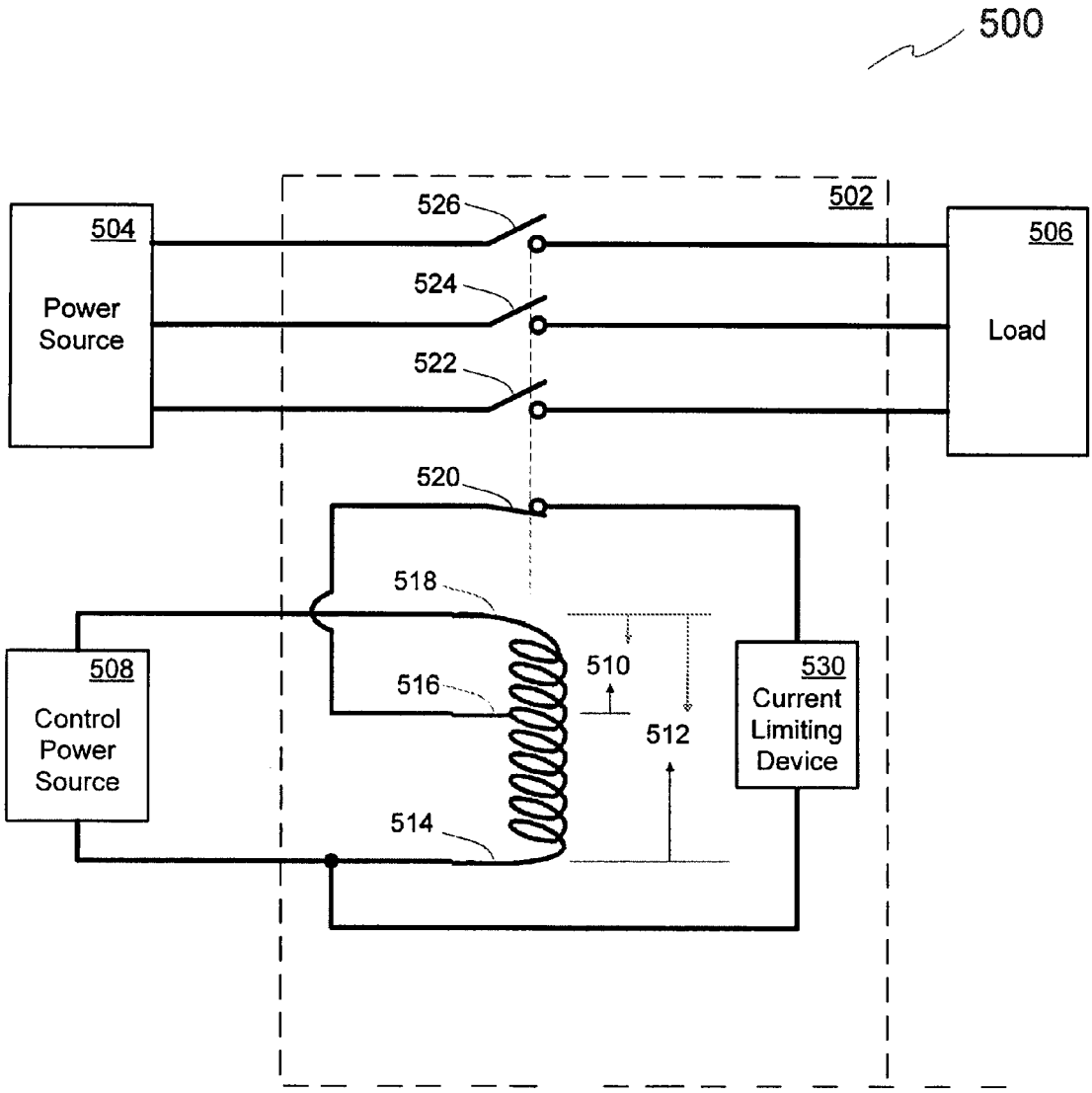
FIG. 4 is a schematic diagram of a power control system including a controlled switch having three load switches in accordance with an embodiment of the present invention.

The power control system 400 of FIG. 4 is identical to the embodiment shown in FIG. 3, except that load switch 422 and load switch 424 are normally closed switches. The power control system 400 can operate as described previously for the embodiment shown in FIG. 3.

A schematic block diagram of a power control system including a controlled switch having three load switches in accordance with an embodiment of the present invention is shown in FIG. 4. The power control system 500 includes a controlled switch 502, a power source 504, a load 506 and a control power source 508. The controlled switch 502 includes a pull-in coil 510, an economizer coil 512, an auxiliary switch 520, a first load switch 522, a second load switch 524, a third load switch 526, and a current limiting device 530. The economizer coil 512 includes a first end 514, a tap 516, and a second end 518, where the pull-in coil consists of the portion of the economizer coil extending from the second end 518 to the tap 516.

The power source 504 is connected to the first load switch 522, the second load switch 524, and the third load switch 526. The first load switch 522, the second load switch 524 and the third load switch 526 are connected to the load 506. The control power source 508 is connected to both the first end 514 and the second end 518 of the economizer coil 512. The auxiliary switch and first and second load switches each include a switch arm and a switch contact. The tap 516 is connected to the auxiliary switch 520. In the illustrated embodiment, the auxiliary switch 520 is normally closed and the load switches are normally open. The four switches are arranged such that all three are switched together. The auxiliary switch is connected to the current limiting device 530. The first end 514 of the economizer coil 512 is connected to the current limiting device 530.

Figure 5:
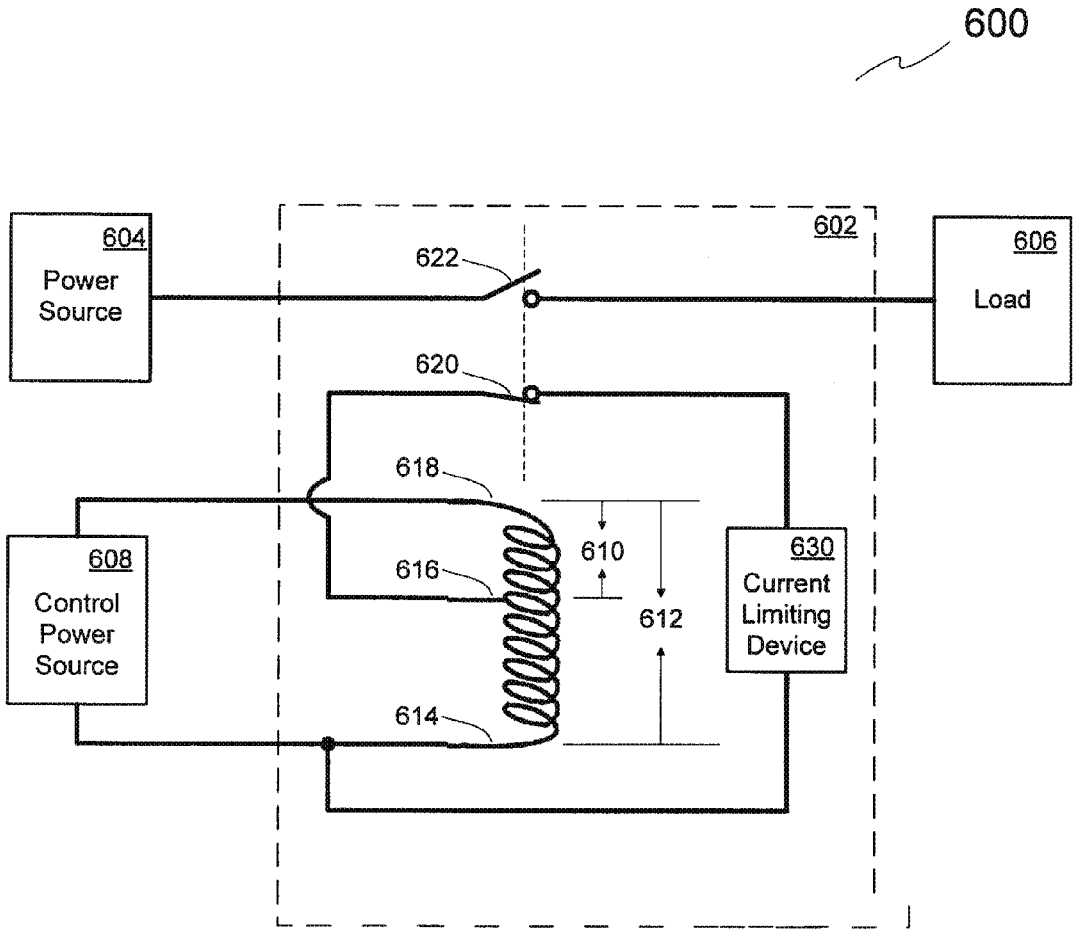
FIG. 5 is a schematic diagram of a power control system including a controlled switch having one load switch in accordance with an embodiment of the present invention.

The power control system 500 of FIG. 5 is nearly identical to the embodiment shown in FIG. 3, except that it includes an additional load switch. The power control system 500 can operate as described previously for the embodiment shown in FIG. 3.

A schematic block diagram of a power control system including a controlled switch having one load switch in accordance with an embodiment of the present invention is shown in FIG. 5. The power control system 600 includes a controlled switch 602, a power source 604, a load 606 and a control power source 608. The controlled switch 602 includes a pull-in coil 610, an economizer coil 612, an auxiliary switch 620, a load switch 622, and a current limiting device 630. The economizer coil 612 includes a first end 614, a tap 616, and a second end 618, where the pull-in coil consists of the portion of the economizer coil extending from the second end 618 to the tap 616.

The power source 604 is connected to the load switch 622. The load switch 622 is connected to the load 606. The control power source 608 is connected to both the first end 614 and the second end 618 of the economizer coil 612. The auxiliary switch and the load switch each include a switch arm and a switch contact. The tap 616 is connected to the auxiliary switch 620. In the illustrated embodiment, the auxiliary switch 620 is normally closed and the load switch is normally open. The two switches are arranged such that they are both switched together. The auxiliary switch is connected to the current limiting device 630. The first end 614 of the economizer coil 612 is connected to the current limiting device 630.

The power control system 600 of FIG. 5 is nearly identical to the embodiment shown in FIG. 2, except that it includes only one load switch. The power control system 600 can operate as described previously for the embodiment shown in FIG. 2.

In one embodiment, any number of load switches can be used in conjunction with at least one auxiliary switch in any number of arrangements of normally open or normally closed default switch settings.

Figure 6:
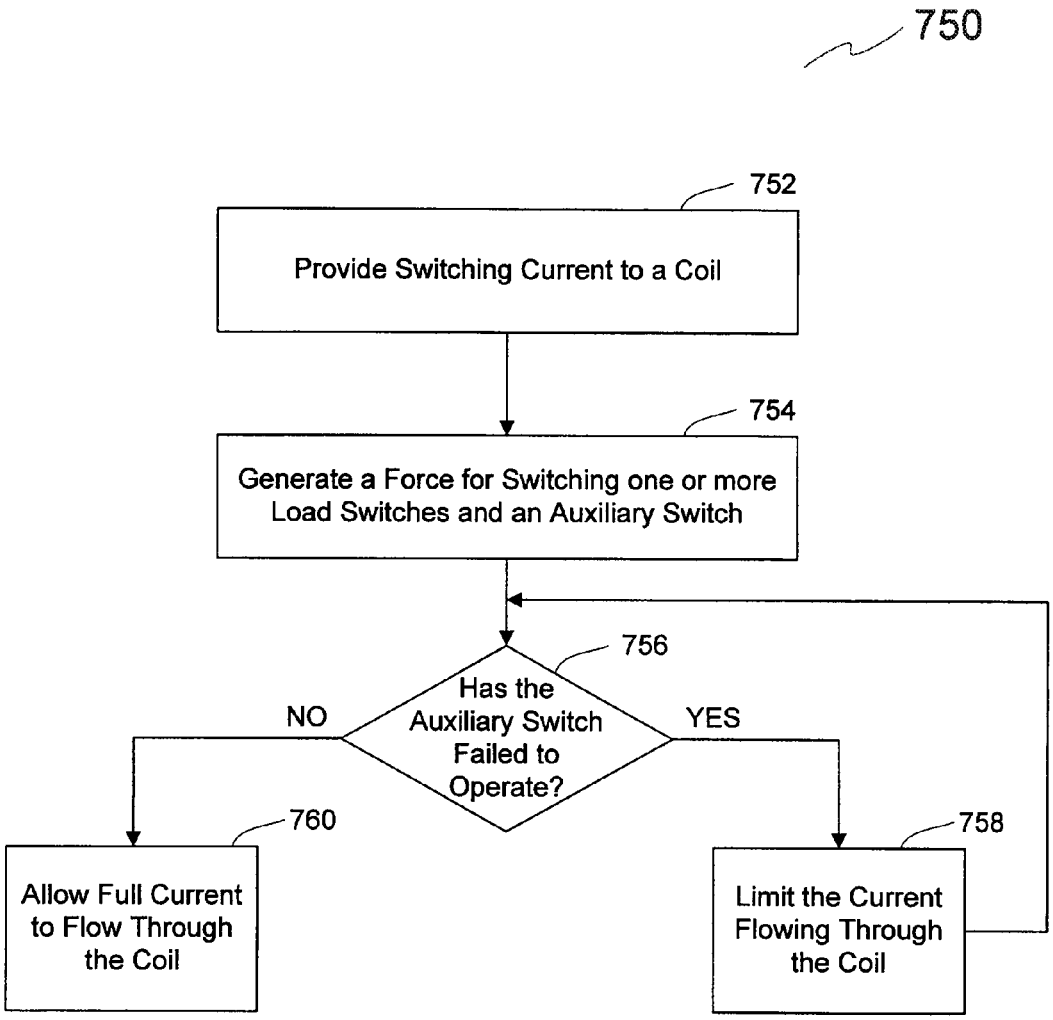
FIG. 6 is a flowchart of a process for operating a controlled switch in accordance with an embodiment of the present invention.

A flowchart of a process for operating a controlled switch in accordance with an embodiment of the present invention is shown in FIG. 6. The process 750 begins when it provides (752) switching current to a coil (e.g. a pull-in coil). The process then generates (754) a force for switching one or more load switches and an auxiliary switch. In one embodiment, the force is proportional to, or a function of, the switching current. The process then determines (756) whether the auxiliary switch failed to operate. In one embodiment, the determination is made based on the amount of current flowing through the current limiting device and the coil. If the auxiliary switch fails to operate, then the process limits (758) the current flowing through the coil and returns to determining (756) whether the auxiliary switch failed to open. In one embodiment, the current flowing through the coil is limited using a resettable fuse. If the auxiliary switch does not fail to operate, then the process allows (760) the full amount of current to flow through the coil.

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. A switch circuit comprising:

at least one load switch connectable between a power source and a load and at least one auxiliary switch, each switch actuable between a default position and a switched position;

a coil structure comprising a main coil and a component coil where the component coil comprises a portion of the main coil, the coil structure configured to actuate the at least one load switch and at least one auxiliary switch in response to a control input, the coil structure switchable between:

an actuating configuration for actuating the at least one load switch and the at least one auxiliary switch from the default position, and a holding configuration for holding the at least one load switch and the at least one auxiliary switch in the switched position; and a resettable current limiting device configured to limit the current flow in the actuating configuration of the coil structure if the current flow exceeds a threshold for a predetermined period of time, wherein the at least one auxiliary switch is configured to switch the coil structure from the actuating configuration to the holding configuration.

2. The switch circuit of claim 1:

wherein the control input and the power source are aircraft electrical power sources; and wherein the load is an aircraft electrical load.

3. The switch circuit of claim 1, wherein an impedance of the resettable device increases at least an order of magnitude when the current exceeds a threshold for a predetermined period of time.

4. The switch circuit of claim 1, wherein the resettable device is configured to allow current to flow with minimal impedance when the current is below the threshold for a predetermined period of time.

5. The switch circuit of claim 1:

wherein a first current supplied by the control input actuates the at least one load switch and the at least one auxiliary switch from the default position;

wherein a second current supplied by the control input holds the at least one load switch and the at least one auxiliary switch in the switched position; and wherein the first current is greater than the second current.

6. The switch circuit of claim 1, wherein the resettable device is one of a thermistor and a positive temperature coefficient device.

7. The switch circuit of claim 1:

wherein the default position of the at least one auxiliary switch is closed; and wherein the default position of the at least one load switch is open.

8. The switch circuit of claim 1:

wherein the default position of the at least one auxiliary switch is closed; and wherein the default position of the at least one load switch is closed.

9. A switch circuit comprising:

at least one load switch connectable between a power source and a load and at least one auxiliary switch, each switch actuable between a default position and a switched position;

a coil structure configured to actuate the at least one load switch and at least one auxiliary switch in response to a control input, the coil structure switchable between:

an actuating configuration for actuating the at least one load switch and the at least one auxiliary switch from the default position, and a holding configuration for holding the at least one load switch and the at least one auxiliary switch in the switched position; and a resettable current limiting device configured to limit the current flow in the actuating configuration of the coil structure if the current flow exceeds a threshold for a predetermined period of time, wherein the at least one auxiliary switch is configured to switch the coil structure from the actuating configuration to the holding configuration, wherein the coil structure comprises a main coil and a component coil, where the component coil is a portion of the main coil extending from a first end of the main coil to a tap of the main coil, wherein the component coil is used in the actuating configuration for actuating the at least one load switch and the at least one auxiliary switch from the default position, and wherein the main coil is used in the holding configuration for holding the at least one load switch and the at least one auxiliary switch in the switched position.

10. The switch circuit of claim 9:

wherein the at least one auxiliary switch is connected between the tap and the resettable device;

wherein the resettable device is connected to a second end of the main coil; and wherein the default position of the at least one auxiliary switch is closed.

11. A method of operating a switch circuit comprising a coil structure configured to actuate at least one load switch and at least one auxiliary switch in response to a control input, the coil structure switchable between an actuating configuration for actuating the at least one load switch and the at least one auxiliary switch from a default position, and a holding configuration for holding the at least one load switch and the at least one auxiliary switch in a switched position, and a resettable current limiting device having a current threshold, the method comprising:

providing a switching current to the coil structure in response to the control input, wherein the coil structure comprises a main coil and a component coil where the component coil comprises a portion of the main coil;

generating, in response to the switching current, a force for switching the at least one load switch and the at least one auxiliary switch, the at least one load switch connectable between a power source and a load; and limiting the switching current flowing through the coil structure using the resettable current limiting device when the switching current exceeds the current threshold for a predetermined period of time, wherein the control input is independent of the power source.

12. The method of claim 11:

wherein the switch circuit further comprises a control power source configured to supply current to the coil structure; and wherein the at least one load switch is connected between a power source and a load.

13. The method of claim 12:

wherein the control power source and the power source are aircraft electrical power sources; and wherein the load is an aircraft electrical load.

14. The method of claim 11, wherein the limiting the switching current flowing through the coil structure using the resettable current limiting device when the switching current exceeds the current threshold for a predetermined period of time comprises substantially limiting the switching current flowing through the coil structure in the actuating configuration using the resettable current limiting device when the switching current exceeds the threshold for a predetermined period of time.

15. The method of claim 11, wherein the limiting the switching current flowing through the coil structure using the resettable current limiting device when the switching current exceeds the current threshold for a predetermined period of time is performed by the resettable current limiting device, where the resistance of resettable device increases at least an order of magnitude when the switching current exceeds the threshold for a predetermined period of time.

16. The method of claim 11, further comprising allowing the switching current to flow with minimal resistance when the switching current is below the current threshold.

17. The method of claim 11:

wherein the switching current supplied by the control input actuates the at least one load switch and the at least one auxiliary switch from the default position;

wherein a holding current supplied by the control input holds the at least one load switch and the at least one auxiliary switch in the switched position; and wherein the switching current is greater than the holding current.

18. The method of claim 11:

wherein the default position of the at least one auxiliary switch is closed; and wherein the default position of the at least one load switch is open.

19. The method of claim 11:

wherein the default position of the at least one auxiliary switch is closed; and wherein the default position of the at least one load switch is closed.

20. A switch circuit for actuating one or more load switches and an auxiliary switch, each of the one or more load switches and the auxiliary switch having a default position and a switched position, where the default position of the auxiliary switch is closed, the switch circuit comprising:

a main coil configured to receive a current from a control power source and to provide a force for holding the one or more load switches and the auxiliary switch in the switched position, where the main coil comprises a first end, a second end and a tap;

a resettable current limiting device connected to the first end of the main coil and to the auxiliary switch;

a component coil comprising a portion of the main coil from the second end to the tap of the main coil, where the tap is connected to the auxiliary switch, and where the component coil is configured to provide a force for actuating the one or more load switches and the auxiliary switch from the default position; and wherein the resettable device configured to limit current flow through the component coil when the current exceeds a threshold for a predetermined period of time.

21. The switch circuit of claim 20, further comprising:

a power source connected to the one or more load switches, the one or more load switches connected to a load.

22. The switch circuit of claim 20, wherein the resettable device is configured to substantially limit current flow when the current exceeds the threshold for a predetermined period of time.

23. The switch circuit of claim 20, wherein a resistance of the resettable device increases at least an order of magnitude when the current exceeds a threshold for a predetermined period of time.

24. The switch circuit of claim 20, wherein the resettable device is configured to allow current to flow with minimal resistance when the current is below the threshold for a predetermined period of time.

25. The switch circuit of claim 20, wherein the resettable device is one of a thermistor and a positive temperature coefficient device.

26. A method of operating a switch circuit comprising a coil structure configured to actuate at least one load switch and at least one auxiliary switch in response to a control input, the coil structure switchable between an actuating configuration for actuating the at least one load switch and the at least one auxiliary switch from a default position, and a holding configuration for holding the at least one load switch and the at least one auxiliary switch in a switched position, and a resettable current limiting device having a current threshold, the method comprising:

providing a switching current to the coil structure in response to the control input;

generating, in response to the switching current, a force for switching the at least one load switch and the at least one auxiliary switch, the at least one load switch connectable between a power source and a load; and limiting the switching current flowing through the coil structure using the resettable current limiting device when the switching current exceeds the current threshold for a predetermined period of time, wherein the control input is independent of the power source, and wherein the limiting the switching current flowing through the coil structure using the resettable current limiting device when the switching current exceeds the current threshold for a predetermined period of time comprises only limiting the switching current flowing through the coil structure using the resettable current limiting device when the auxiliary switch fails.

27. A switch circuit comprising:

at least one load switch connectable between a power source and a load and at least one auxiliary switch, each switch actuable between a default position and a switched position;

a coil structure configured to actuate the at least one load switch and at least one auxiliary switch in response to a control input, the coil structure switchable between:

an actuating configuration for actuating the at least one load switch and the at least one auxiliary switch from the default position, and a holding configuration for holding the at least one load switch and the at least one auxiliary switch in the switched position; and a resettable current limiting device configured to limit the current flow in the actuating configuration of the coil structure if the current flow exceeds a threshold for a predetermined period of time, wherein the at least one auxiliary switch is configured to switch the coil structure from the actuating configuration to the holding configuration, wherein the resettable current limiting device is coupled across the coil structure, and wherein the resettable current limiting device is coupled in series with the auxiliary switch.

28. The switch circuit of claim 27, wherein the control input is independent of the power source.

* * * * *

UNITED STATES PATENT AND TRADEMARK OFFICE

CERTIFICATE OF CORRECTION

PATENT NO. : 7,995,320 B2
APPLICATION NO. : 11/941898
DATED : August 9, 2011
INVENTOR(S) : Farshid Tofigh et al.

It is certified that error appears in the above-identified patent and that said Letters Patent is hereby corrected as shown below:

Column 9, Claim 15, line 29 Delete "of" Insert -- of the --

Signed and Sealed this
Eighteenth Day of December, 2012

David J. Kappos

David J. Kappos
*Director of the United States Patent and Trademark Office*